US005748154A

United States Patent [19]

Yokota

[11] Patent Number: 5,748,154

[45] Date of Patent: May 5, 1998

[54] MINIATURE ANTENNA FOR PORTABLE RADIO COMMUNICATION EQUIPMENT

[75] Inventor: Yasuhiro Yokota, Kawasaki, Japan

[73] Assignee: Fujitsu Limited, Kanagawa, Japan

[21] Appl. No.: 332,424

[22] Filed: Oct. 31, 1994

Related U.S. Application Data

[63] Continuation of Ser. No. 953,379, Sep. 30, 1992, abandoned.

[51] Int. Cl.[6] ..... H01Q 1/24; H01Q 9/04

[52] U.S. Cl. ..... 343/702; 343/791; 343/792

[58] Field of Search ..... 343/702, 791, 343/792, 718, 749, 790; H01Q 9/16, 1/24

[56] References Cited

U.S. PATENT DOCUMENTS

| | | | |
|---|---|---|---|
| 2,297,513 | 9/1942 | Von Baeyer | 343/791 |
| 2,767,395 | 10/1956 | Margerum et al. | 343/791 |
| 3,293,646 | 12/1966 | Brueckmann | 343/791 |
| 3,945,013 | 3/1976 | Brunner et al. | 343/791 |
| 4,366,485 | 12/1982 | Hodgkinson | 343/791 |
| 4,504,834 | 3/1985 | Garay et al. | 343/749 |
| 4,509,056 | 4/1985 | Ploussios | 343/791 |
| 4,829,316 | 5/1989 | Nakasa et al. | 343/791 |
| 4,940,989 | 7/1990 | Austin | 343/792 |
| 5,231,412 | 7/1993 | Eberhardt et al. | 343/895 |

OTHER PUBLICATIONS

"Dipoles and Monopoles", Chen To Tai, Antenna Engineering Handbook, 2nd Edition, Chapter 4, pp. 4–4 to 4–5.

*Primary Examiner*—Michael C. Wimer

*Attorney, Agent, or Firm*—Nikaido, Marmelstein, Murray & Oram LLP

[57] ABSTRACT

A miniature antenna is mounted on a casing of a radio communication equipment such as a portable transmitter/receiver, a pocket telephone, or a mobile telephone of low power type. The miniature antenna is includes a semi-coaxial dielectric resonator and a radiator. The semi-coaxial dielectric resonator has a metal case, a center conductor surrounded by the metal case, and a dielectric material filled between the metal case and the center conductor. The radiator is formed by extending the center conductor approximately the same length as the center conductor and projected from the metal case without contacting the case. A skirt member can be added outside of the semi-coaxial dielectric resonator. According to the above-described structure, the directivity becomes maximum in a horizontal plane and an effect caused by holding the casing with a human hand is decreased.

8 Claims, 12 Drawing Sheets

MINIATURE ANTENNA FOR PORTABLE RADIO COMMUNICATION EQUIPMENT

This application is a continuation of application Ser. No. 07/953,379 filed Sep. 30, 1992 abandoned.

BACKGROUND OF THE INVENTION

1) Field of the Invention

The present invention relates to a miniature antenna for portable radio communication equipment. More specifically, the present invention relates to a very small antenna mounted on the casing of a portable transmitter/receiver or a pocket telephone (mobile telephone) of a small power type used for an in-plant communication system or a tele-terminal.

2) Description of the Related Art

Recently, according to developments in radio communication equipment, a number of communication systems have adopted a radio communication system instead of using a wired system. As a result, there are no useable frequencies left in the low frequency band, so that gradually higher frequencies are being assigned for new radio communication systems, for example, frequency bands of 400 MHz to 800 MHz are assigned. It is now being planned to use the 1500 MHz band for a relational radio communication system as described above, and as explained hereinafter.

In this way, as the frequencies used for radio communication systems get higher, the length of the antenna required gets shorter and the size gets smaller. However, as the size of the antenna gets smaller, it becomes more difficult to obtain a desirable antenna directivity.

Conventionally, a whip antenna that has a small-diameter and a vertical rod, and a helical antenna that has a coil shape and is mounted perpendicular to a flat metal-plate reflector, are used especially in mobile communications, portable radio and television receivers, field-strength meters, and the like. A dimensional relationship between the whip antenna or the helical antenna and the casing thereof is different in accordance with the transmitting/receiving frequency required for the antenna. Usually, a casing of radio communication equipment having the whip or helical antenna is not designed in accordance with the optimum radiation therefrom but is designed in accordance with the performance and the output power of the equipment.

Accordingly, in the conventional antenna, as the transmitting/receiving frequency required for the antenna gets higher, the antenna does not provide the desired directivity. Further, in conventional radio communication equipment having an antenna, a return current from the antenna flows in the casing of the radio communication equipment, so the directivity of the antenna changes when the casing is held by a human hand. Furthermore, in the conventional antenna, if the efficiency of the antenna is a priority, a ¼ wave length antenna is required, and the length of the antenna becomes long.

Incidentally, detachable antennas for some kinds of radio communication equipment are prohibited under the law, so that the downsizing of the antenna is required for this kind of antenna.

SUMMARY OF THE INVENTION

An object of the present invention is to provide a miniature antenna for a portable transmitter/receiver or a pocket telephone (mobile telephone) of a small power type used for an in-plant communication system or a tele-terminal, whose directivity can be maximum in a horizontal plane, and having little effect from a human body when the casing is held by a human hand.

According to an aspect of the present invention, there is provided a miniature antenna for radio communication equipment such as a portable transmitter/receiver, a pocket telephone, or a mobile telephone of a small power type, and mounted on the casing thereof, the miniature antenna comprising: a semi-coaxial dielectric resonator consisting of a metal case, a center conductor surrounded by the metal case, and a dielectric material filled between the metal case and the center conductor; and a radiator formed by extending the center conductor and projected from the metal case through the hole provided on the upper bottom thereof.

According to another aspect of the present invention, there is provided a miniature antenna further comprising a metal skirt member having a larger diameter than that of the resonator with its upper end electrically connected to the upper bottom of the resonator, with the skirt member serving as a lower radiator and the radiator serving as an upper radiator of a miniature dipole antenna structure.

According to the miniature antenna of the present invention, transmitting/receiving of radio waves is carried out by the radiator projected from the metal case, and transferring power to and from the radio communication equipment is carried out efficiently by means of the matching circuit of the semi-coaxial dielectric resonator. Moreover, according to the miniature antenna having the skirt member of the present invention, transmitting/receiving of the radio waves is carried out by the lower radiator (the skirt member) and the upper radiator (extended part of the center conductor), and transferring power to and from the radio communication equipment is carried out efficiently through the matching circuit of the semi-coaxial dielectric resonator.

Further, according to the miniature antenna having the support member, power is supplied to the semi-coaxial dielectric resonator through the support member, and the antenna characteristics become stable due to the surface current stopping member provided around the support member.

BRIEF DESCRIPTION OF THE DRAWINGS

The present invention will be more clearly understood from the description as set forth below, with reference to the accompanying drawings wherein.

DESCRIPTION OF THE PREFERRED EMBODIMENTS

Before describing the preferred embodiments, an explanation will be given of the conventional antenna, with reference to FIGS. 1 to 4C.

Figure 1:
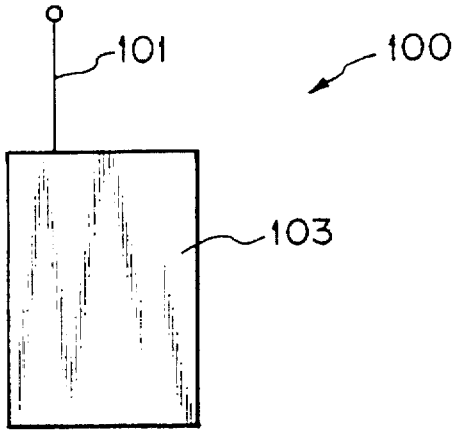
FIG. 1 shows a front view of a portable radio communication equipment having a whip antenna.
Figure 2:
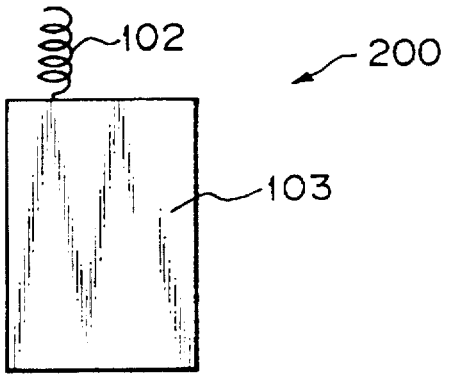
FIG. 2 shows a front view of a portable radio communication equipment having a helical antenna.

FIG. 1 is a front view of a portable radio communication equipment 100 having a whip antenna 101 on the casing 103, and FIG. 2 is a front view of another portable radio communication equipment 200 having a helical antenna 102 on the casing 103. The whip antenna 101 has a small-diameter and a vertical rod and the helical antenna 102 has a coil shape, and both are mounted perpendicular to the casing 103.

Figure 3A:
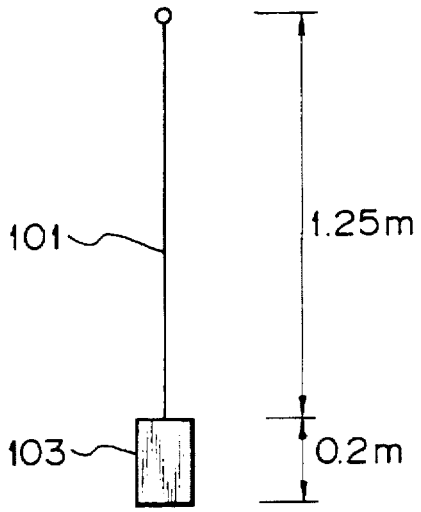
FIG. 3A is an explanatory view showing a relationship between the length of the whip antenna and the casing of the portable radio communication equipment at the transmitting/receiving frequency of 60 MHz.
Figure 3B:
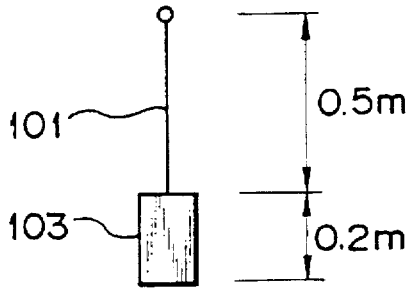
FIG. 3B is an explanatory view showing a relationship between the length of the whip antenna and the casing of the portable radio communication equipment at the transmitting/receiving frequency of 150 MHz.
Figure 3C:
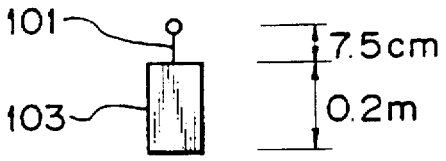
FIG. 3C is an explanatory view showing a relationship between the length of the whip antenna and the casing of the portable radio communication equipment at the transmitting/receiving frequency of 800 MHz.

A dimensional relationship between the whip antenna 101 and the casing 103 is different in accordance with the transmitting/receiving frequency required for the whip antenna 101 as shown in FIG. 3A to 3C. The whip antenna 101 in FIG. 3A having a height of 1.25 m is suitable for transmitting/receiving a frequency of 60 MHz, the whip antenna 101 in FIG. 3B having a height of 0.5 m is suitable for transmitting/receiving a frequency of 150 MHz, and the whip antenna 101 in FIG. 3C having a height of 7.5 cm is suitable for transmitting/receiving a frequency of 800 MHz, although the height of the casing 103 is always 0.2 m. As shown in FIGS. 3A to 3C, the casing 103 of the radio communication equipment having the whip antenna 101 is not designed in accordance with the optimum radiation therefrom but is designed in accordance with the performance and the output power of the equipment.

Figure 4A:
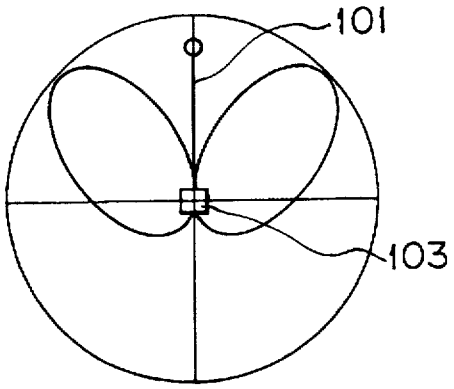
FIG. 4A is a directional characteristic pattern in a vertical plane of a whip antenna shown in FIG. 3A.
Figure 4B:
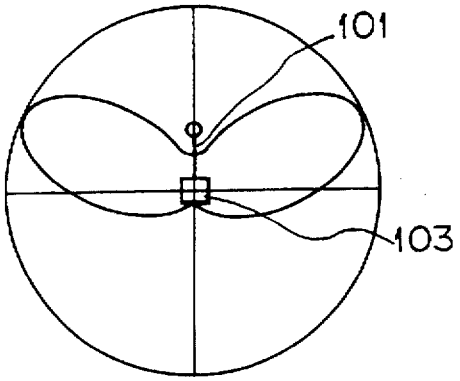
FIG. 4B is a directional characteristic pattern in a vertical plane of a whip antenna shown in FIG. 3B.
Figure 4C:
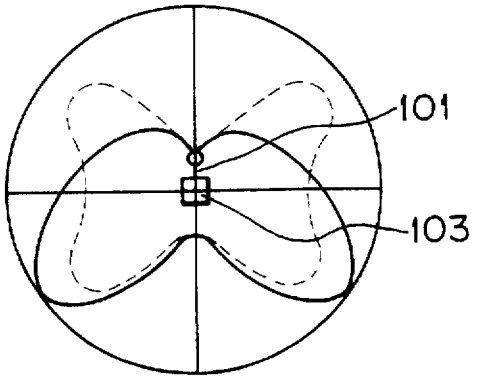
FIG. 4C is a directional characteristic pattern in a vertical plane of a whip antenna shown in FIG. 3C.

However, in the prior art, when the transmitting/receiving frequency required for the whip antenna gets higher, the directivity of the whip antenna does not agree with the desired directivity as shown in FIGS. 4A to 4C. FIG. 4A is a directional characteristic pattern in a vertical plane of the whip antenna 101 shown in FIG. 3A (60 MHz), FIG. 4B is the same pattern of the whip antenna 101 shown in FIG. 3B (150 MHZ), and FIG. 4C is the same pattern of the whip antenna 101 shown in FIG. 3C (800 MHz).

Further, in the conventional radio communication equipment having the whip antenna 101, a return current from the antenna 101 flows in the casing 103 of the radio communication equipment, so that the directivity of the antenna changes when the manner of holding the casing 103 by a human hand is changed. The dash line in FIG. 4C is the directional characteristic pattern in a vertical plane of the whip antenna 101 when the manner of holding the casing 103 by a human hand is changed.

These defects especially exist in miniature antennas for radio communication equipment. Accordingly, it is desired to realize a miniature antenna having efficient and desirable directivity characteristics for portable radio communication equipment.

Figure 5:
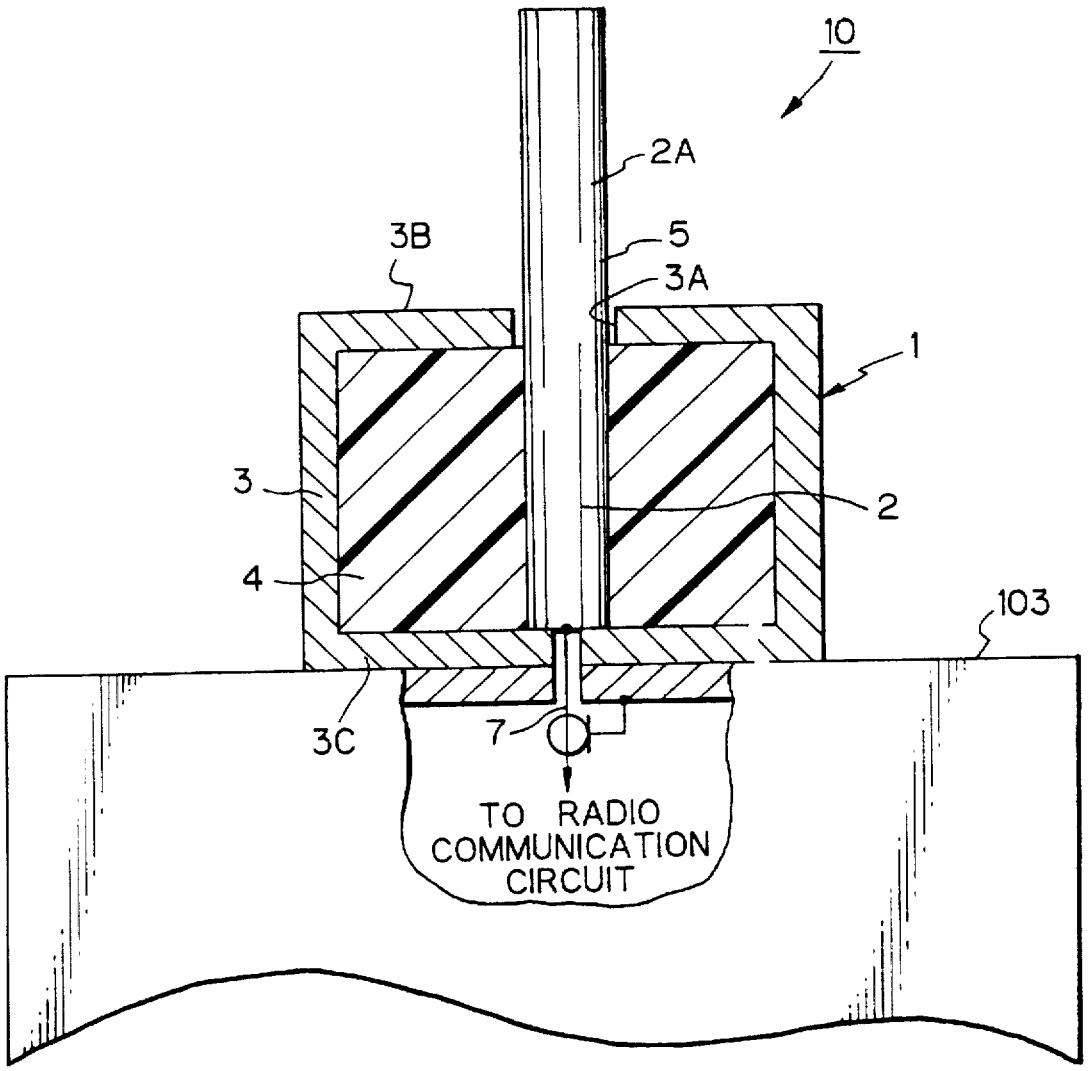
FIG. 5 is a side elevational view, partly in cross section, of a miniature antenna mounted on the casing of the portable radio communication equipment according to the first embodiment of the present invention.

FIG. 5 is a side elevational view, partly in cross section, of a miniature antenna 10 of the first embodiment according to the present invention, mounted on the casing 103 of the portable radio communication equipment. In FIG. 5, reference numeral 1 denotes a semi-coaxial dielectric resonator, 2 denotes a center conductor, 2A denotes an extended part of the center conductor 2, 3 denotes a metal case, 3A denotes a hole for penetrating the extended part 2A of the center conductor 2, 3B denotes an upper portion of the metal case 3, 3C denotes a lower portion of the metal case 3, 4 denotes an dielectric material, 5 denotes a upper radiator, and 7 denotes a power supply line (signal line) connecting the center conductor 2 to a radio communication circuit (not shown) provided in the casing 103 of the equipment. The lower portion 3C is mounted on the casing 103 of the radio communication equipment.

The semi-coaxial dielectric resonator 1 consists of the metal case 3, the center conductor 2 surrounded by the metal case 3, and the dielectric material 4 filled between the metal case 3 and the center conductor 2. The radiator 5 is formed by the extended part 2A of the center conductor 2. The radiator 5 has approximately the same length as the center conductor 2 and is projected from the metal case 3 through the hole 3A provided on the upper portion 3B of the metal case 3.

Generally, a resonance frequency for a coaxial resonator having a center conductor of a predetermined length surrounded by a metal case is fixed. Contrary to this, the same resonance frequency can be achieved with a shorter center conductor if a capacitor is inserted between the center conductor and the metal case. This type of coaxial resonator is called a semi-coaxial resonator. Further, if a dielectric material is filled in the metal case, the length of the center conductor can be still shorter than that of the center conductor in the semi-coaxial resonator. This type of semi-coaxial conductor is called a semi-coaxial dielectric resonator.

According to the miniature antenna 10 of the present invention, transmitting/receiving of radio waves is carried out by the radiator 5 projected from the metal case 3, and transferring power to and from the radio communication equipment is carried out efficiently through the power supply line 7 by means of the matching circuit of the semi-coaxial dielectric resonator 1.

Figure 6:
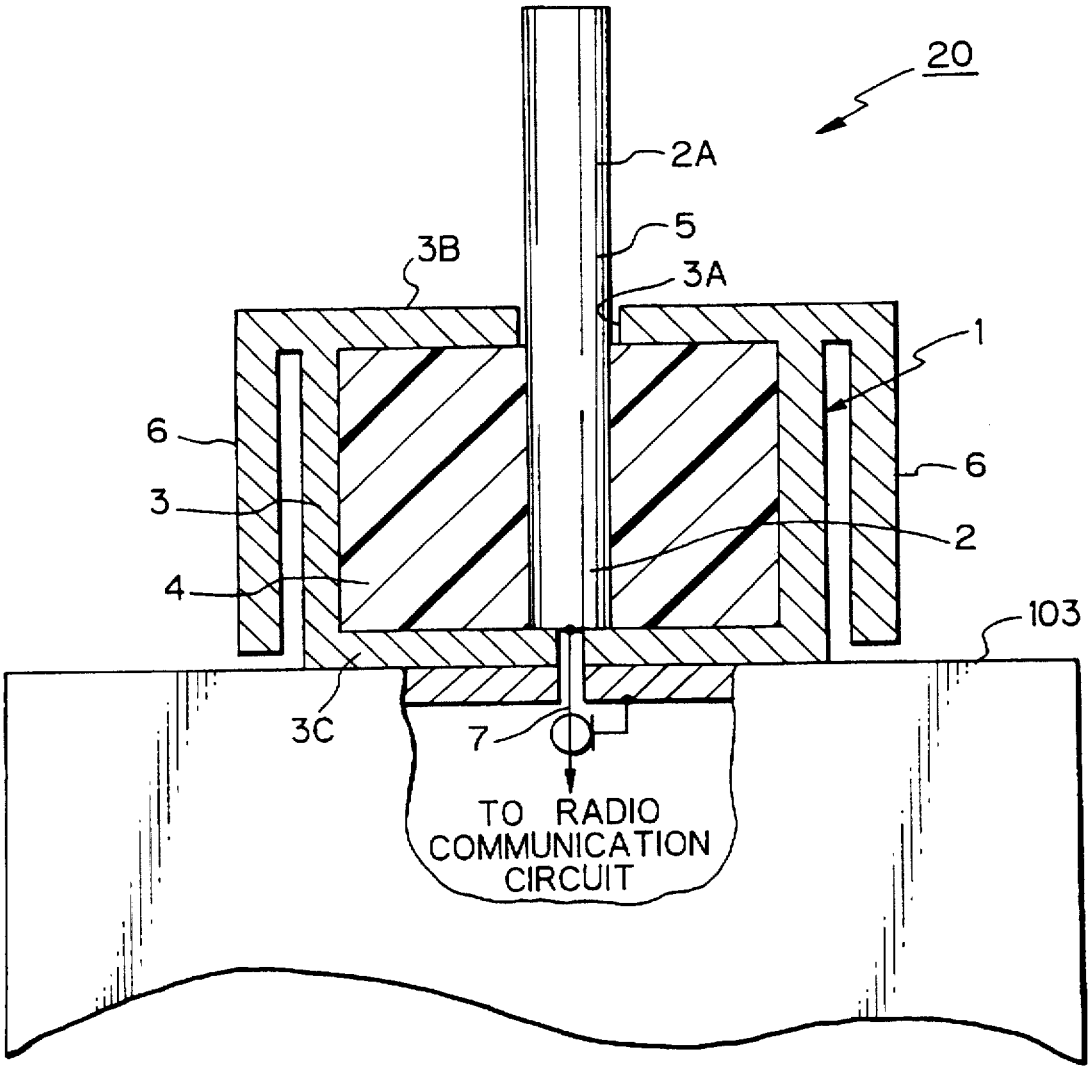
FIG. 6 is a side elevational view, partly in cross section, of a miniature antenna mounted on the casing of the portable radio communication equipment according to the second embodiment of the present invention.

FIG. 6 is a side elevational view, partly in cross section, of a miniature antenna 20 of the second embodiment according to the present invention, mounted on the casing 103 of the portable radio communication equipment. In this embodiment, the structure of the miniature antenna 20 is the same as the miniature antenna 10 of the first embodiment as shown in FIG. 5, except that a metal skirt member 6 is added around the semi-coaxial dielectric resonator 1. Accordingly, in FIG. 6, the same parts as used in FIG. 5 are assigned the same reference numerals and the explanation thereof is omitted.

In the second embodiment, the metal skirt member 6 is a tube, having a larger diameter than that of the resonator 1. The upper end of the skirt member 6 is electrically connected to the upper portion 3B of the resonator 1. The skirt member 6 serves as a lower radiator and the radiator 5 serves as an upper radiator of a miniature dipole antenna structure.

According to the miniature antenna 20 of the present invention, transmitting/receiving of radio waves is carried out by the radiator 5 and the skirt member 6 forming the dipole antenna structure, and transferring power to and from the radio communication equipment is carried out efficiently through the power supply line 7 by means of the matching circuit of the semi-coaxial dielectric resonator 1.

Figure 7:
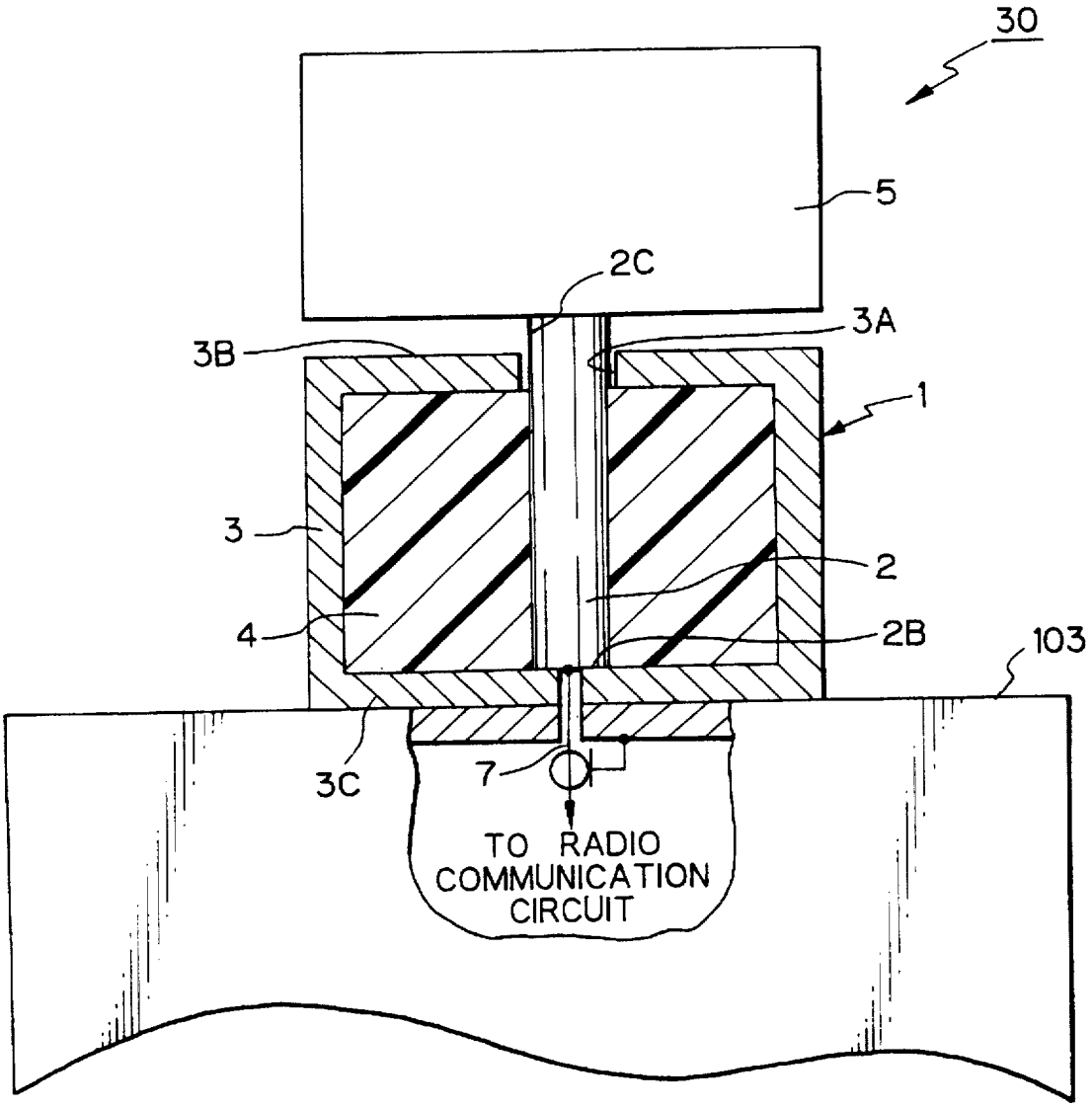
FIG. 7 is a side elevational view, partly in cross section, of a miniature antenna mounted on the casing of the portable radio communication equipment according to the third embodiment of the present invention.

FIG. 7 is a side elevational view, partly in cross section, of a miniature antenna 30 of the third embodiment according to the present invention, mounted on the casing 103 of the portable radio communication equipment. In this embodiment, the structure of the miniature antenna 30 is the same as the miniature antenna 10 of the first embodiment as shown in FIG. 5, except that the diameter of the radiator 5 is enlarged approximately equal to the diameter of the resonator 1.

Accordingly, in FIG. 7, the same parts as used in FIG. 5 are assigned the same reference numerals and the explanation thereof is omitted. In the third embodiment, the center conductor 2 is short-circuited at the bottom end 2B and is separated from the shield by the metal case 3.

According to the miniature antenna 30 of the present invention, transmitting/receiving of radio waves is carried out by the enlarged radiator 5 projected from the metal case 3, and transferring power to and from the radio communication equipment is carried out efficiently through the power supply line 7 by means of the matching circuit of the semi-coaxial dielectric resonator 1.

Figure 8:
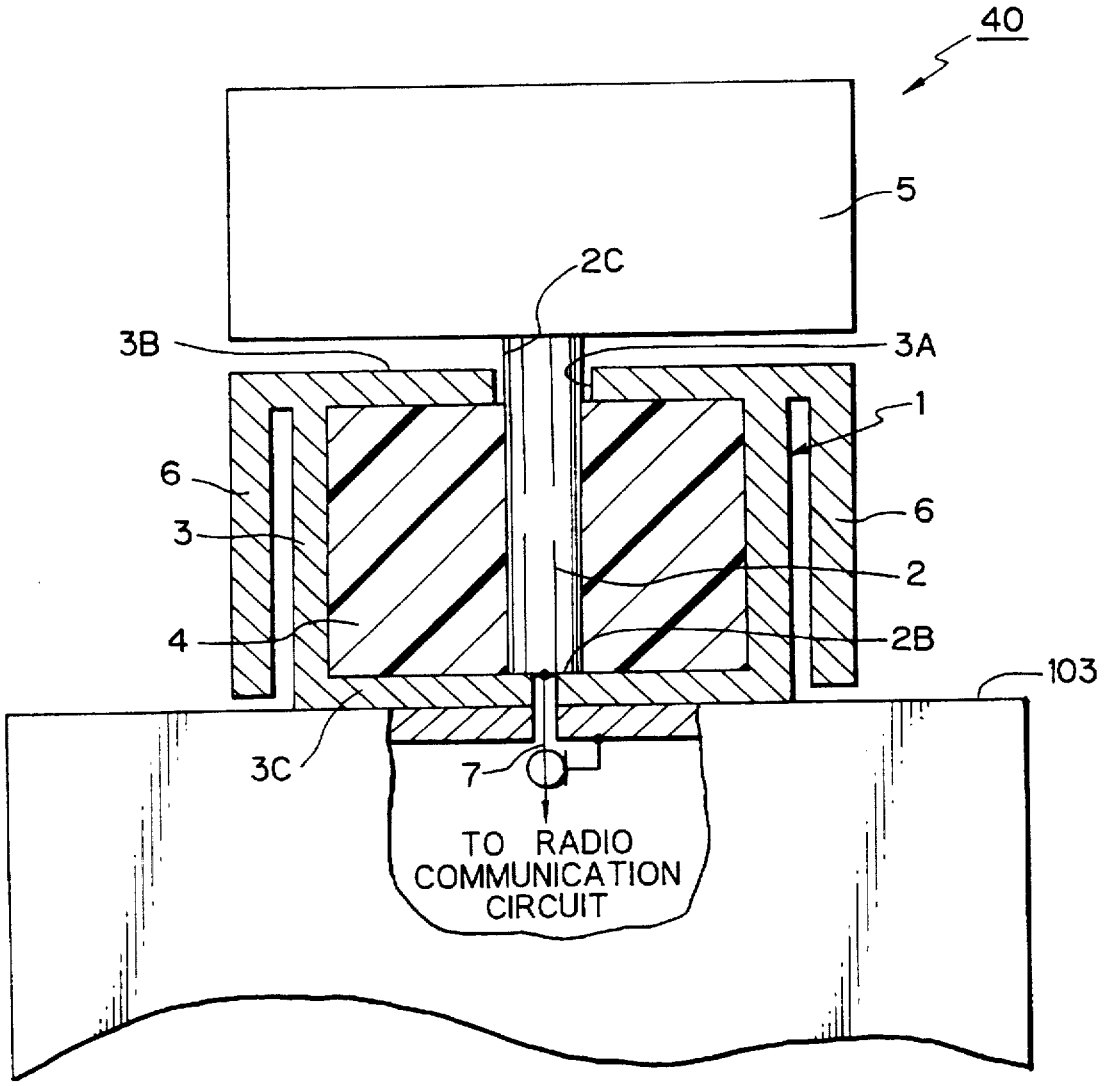
FIG. 8 is a side elevational view, partly in cross section, of a miniature antenna mounted on the casing of the portable radio communication equipment according to the fourth embodiment of the present invention.

FIG. 8 is a side elevational view, partly in cross section, of a miniature antenna 40 of the fourth embodiment according to the present invention, mounted on the casing 103 of the portable radio communication equipment. In this embodiment, the structure of the miniature antenna 40 is the same as the miniature antenna 20 of the second embodiment as shown in FIG. 6, except that the diameter of the radiator 5 is enlarged approximately equal to the diameter of the skirt member 6. Accordingly, in FIG. 8, the same parts as used in FIG. 6 are assigned the same reference numerals and the explanation thereof is omitted.

In the fourth embodiment, the skirt member 6 serves as a lower radiator and the enlarged radiator 5 serves as an upper radiator of a miniature dipole antenna structure. According to the miniature antenna 40 of the present invention, transmitting/receiving of radio waves is carried out by the radiator 5 and the skirt member 6 forming the dipole antenna structure, and transferring power to and from the radio communication equipment is carried out efficiently through the power supply line 7 by means of the matching circuit of the semi-coaxial dielectric resonator 1.

The relationship between the length of the antenna and the impedance thereof are as follows: when the length of the antenna is shortened, the antenna is replaced by a series connected small capacitance $\Delta C$ and small resistance $\Delta R$, so that the shorter the length of the antenna, the higher the Q of the antenna. In this way, when the length of the antenna is shortened, the Q of the antenna becomes higher. However, since it is easy to set high a Q for the semi-coaxial dielectric resonator 1, it is possible to match the antenna by using the semi-coaxial dielectric resonator 1. Accordingly, the efficiency of the antenna will not be decreased if the length of the antenna is shortened.

Figure 9:
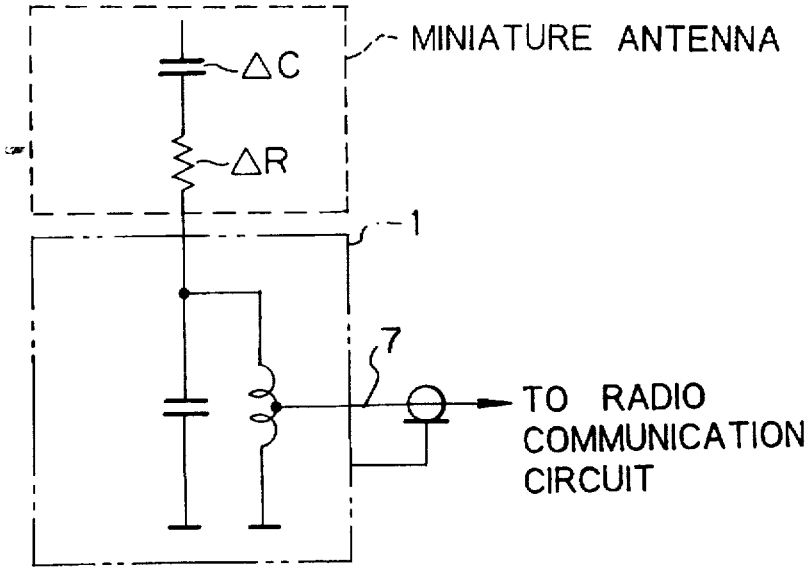
FIG. 9 is a equivalent circuit diagram of the miniature antenna according to the present invention.

FIG. 9 is an equivalent circuit diagram of the miniature antennas 10 to 40 having the semi-coaxial dielectric resonator 1 according to the present invention. From this equivalent circuit diagram, it will be understood that the high Q and the high impedance of the miniature antenna is connected to the radio communication circuit after being converted to an impedance that can be handled, by the the impedance conversion circuit consisting of the semi-coaxial dielectric resonator 1.

According to the above-described structure of the miniature antenna, transmitting/receiving of radio waves is carried out by the lower radiator (the skirt member 6) and the upper radiator 5 (extended part 2A of the center conductor 2), and transferring power to and from the radio communication circuit is carried out efficiently through the matching circuit of the semi-coaxial dielectric resonator 1.

In this way according to the present invention, a small and efficient antenna can be provided. Further, due to the semi-coaxial dielectric resonator 1 having a high Q, the miniature antenna according to the present invention has desirable frequency characteristics. Furthermore, since the length of the projected part of the antenna from the metal case 3 is short, the miniature antenna according to the present invention is not as unstable as a whip antenna. Accordingly, the miniature antenna of the invention has little chance of being broken off at the base by means of vibration, etc.

Figure 10:
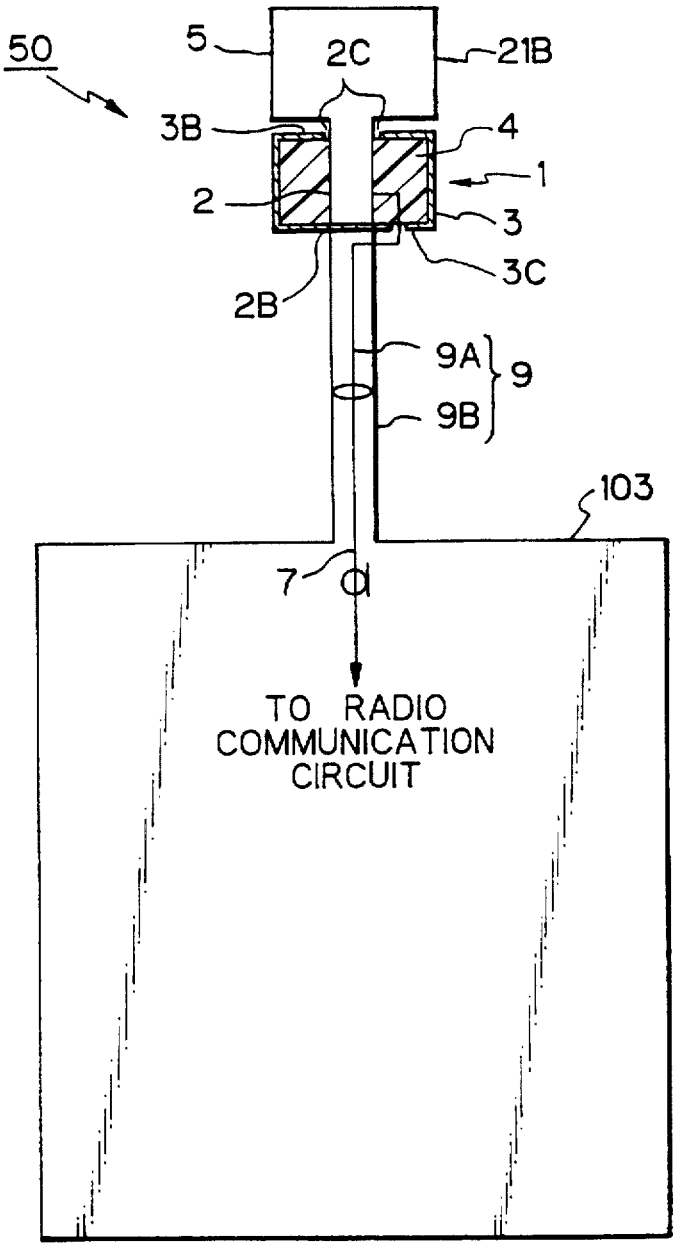
FIG. 10 is a side elevational view, partly in cross section, of a miniature antenna mounted on the casing of the portable radio communication equipment according to the fifth embodiment of the present invention.

FIG. 10 is a side elevational view, partly in cross section, of a miniature antenna 50 of the fifth embodiment according to the present invention, mounted on the casing 103 of the portable radio communication equipment. In this embodiment, the structure of the miniature antenna 50 is the same as the miniature antenna 30 of the third embodiment as shown in FIG. 7 except that the semi-coaxial dielectric resonator 1 is held by a support member 9 serving as a power supply line. Accordingly, in FIG. 10, the same parts as used in FIG. 7 are assigned the same reference numerals and the explanation thereof is omitted.

In the fifth embodiment, the support member 9 serving as a power supply line is formed by the coaxial line, a center line 9A thereof is connected to the center conductor 2 and serves as the power supply line and a covering 9B thereof is connected to the casing 103 of the radio communication equipment that is at ground level.

According to the miniature antenna 50 of the fifth embodiment constructed above, transmitting/receiving of radio wave is carried out by the enlarged radiator 5 projected from the metal case 3, and transferring power to and from the radio communication equipment is carried out efficiently through the power supply line 7 by means of the matching circuit of the semi-coaxial dielectric resonator 1 similar to the second embodiment. Accordingly, by the fifth embodiment, it can be realized not only good frequency characteristics and efficiency but also prevention of a negative influence from the casing 103, can be realized since the semi-coaxial dielectric resonator 1 (antenna part of the radio communication equipment) is far from the casing 103 by the support member 9.

Figure 11:
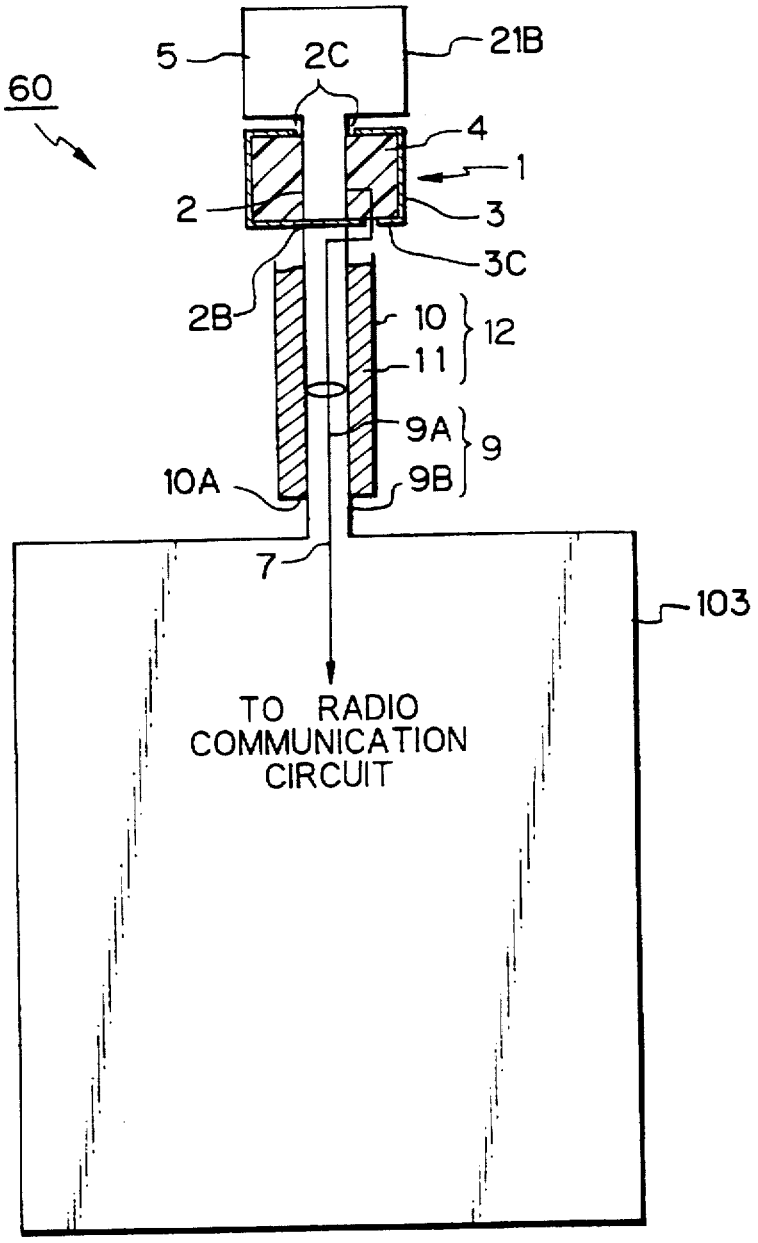
FIG. 11 is a side elevational view, partly in cross section, of a miniature antenna mounted on the casing of the portable radio communication equipment according to the sixth embodiment of the present invention.

FIG. 11 is a side elevational view, partly in cross section, of a miniature antenna 60 of the sixth embodiment according to the present invention, mounted on the casing 103 of the portable radio communication equipment. In this embodiment, the structure of the miniature antenna 60 is the same as the miniature antenna 50 of the fifth embodiment as shown in FIG. 10 except that a surface current stopping member 12 is provided around the support member 9. The surface current stopping member 12 consists of a metal tube 10 having a larger diameter than that of the support member 9 with its bottom end 10A electrically connected to the support member 9, and a dielectric 11 filled between the metal tube 10 and the support member 9. The function of the surface current stopping member 12 is to prevent a current flow to the casing 103, namely, due to the existence of the surface current stopping member 12, an unbalanced current does not flow to the lower part of the support member 9.

According to the miniature antenna 60 of the sixth embodiment constructed above, the effect of the stability of the antenna characteristics is added to the effect of the miniature antenna 50 of the fifth embodiment shown in FIG. 10.

Figure 12:
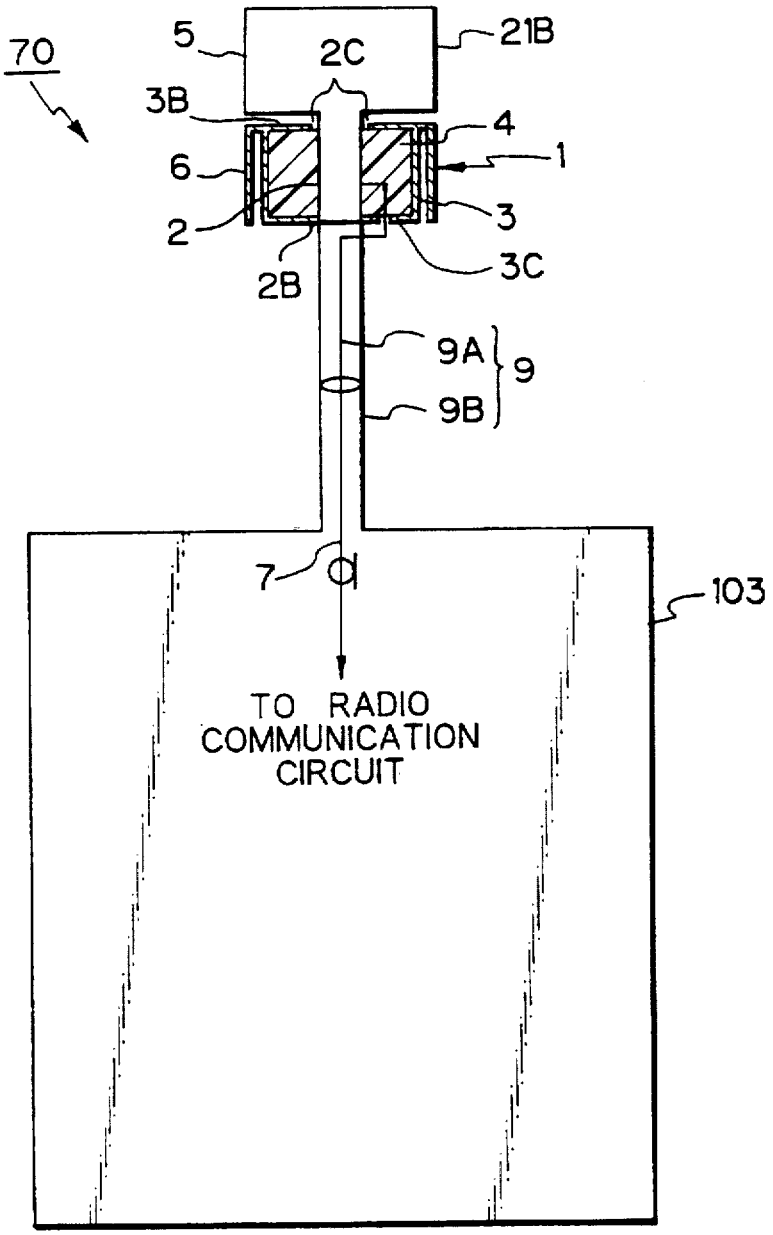
FIG. 12 is a side elevational view, partly in cross section, of a miniature antenna mounted on the casing of the portable radio communication equipment according to the seventh embodiment of the present invention.

FIG. 12 is a side elevational view, partly in cross section, of a miniature antenna 70 of the seventh embodiment according to the present invention, mounted on the casing 103 of the portable radio communication equipment. In this embodiment, the structure of the miniature antenna 70 is the same as the miniature antenna 40 of the fourth embodiment as shown in FIG. 8 except that the semi-coaxial dielectric resonator 1 is held by a support member 9 serving as a power supply line.

The support member 9 is constructed similar to the fifth embodiment in FIG. 10. Accordingly, in FIG. 12, the same parts as used in FIGS. 8 and 10 are assigned the same reference numerals and the explanation thereof is omitted.

According to the miniature antenna 70 of the seventh embodiment constructed above, the effect of the improvement of the efficiency of transferring power to and from the radio communication equipment is added to the effect of the miniature antenna 40 of the fourth embodiment shown in FIG. 8.

Figure 13:
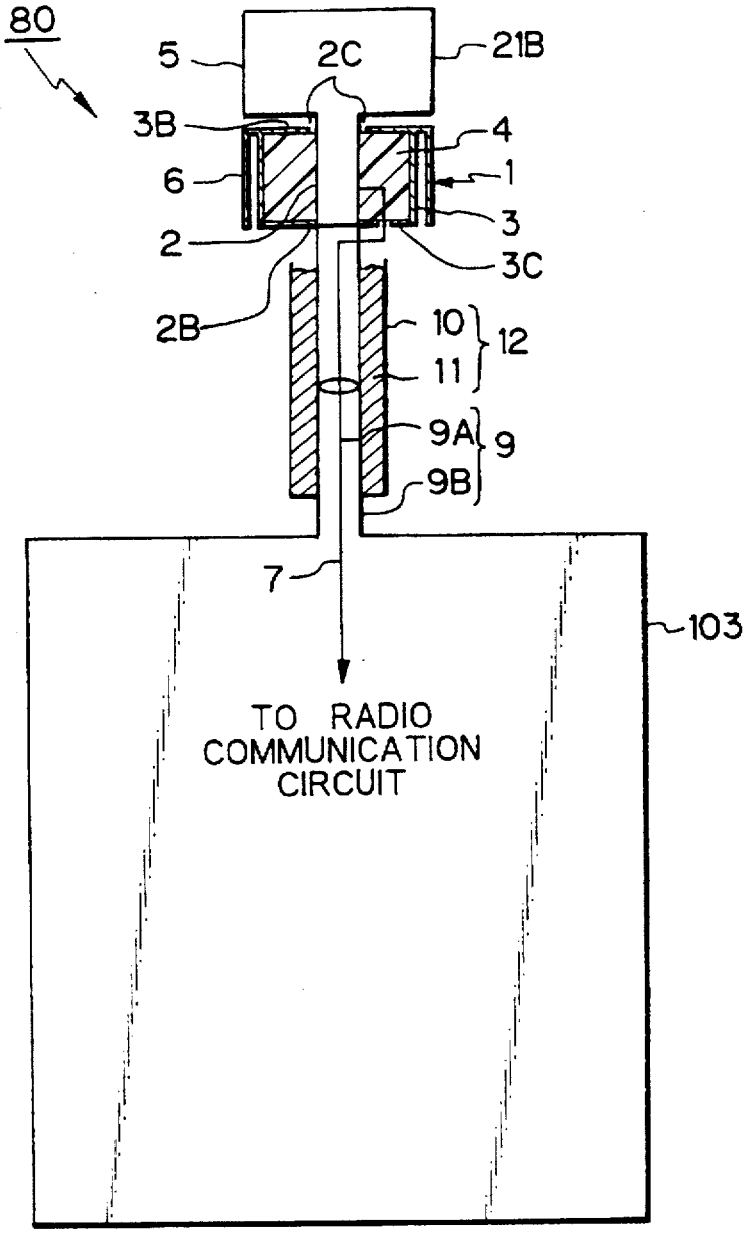
FIG. 13 is a side elevational view, partly in cross section, of a miniature antenna mounted on the casing of the portable radio communication equipment according to the eighth embodiment of the present invention.

FIG. 13 is a side elevational view, partly in cross section, of a miniature antenna 80 of the eighth embodiment according to the present invention, mounted on the casing 103 of the portable radio communication equipment. In this embodiment, the structure of the miniature antenna 80 is the same as the miniature antenna 70 of the seventh embodiment as shown in FIG. 12 except that a surface current stopping member 12 is provided around the support member 9.

The surface current stopping member 12 is constructed similar to the sixth embodiment in FIG. 11. Accordingly, in FIG. 13, the same parts as used in FIGS. 11 and 12 are assigned the same reference numerals and the explanation thereof is omitted.

According to the miniature antenna 80 of the eighth embodiment constructed above, the effect of the stability of the antenna characteristics is added to the effect of the miniature antenna 70 of the seventh embodiment shown in FIG. 12.

What is claimed is:

1. A miniature antenna for a radio communication equipment including a portable transmitter/receiver, a pocket telephone, or a mobile telephone of a low power type, and said miniature antenna mounted on a casing thereof, said miniature antenna comprising:

a semi-coaxial dielectric resonator having a) a metal case, b) a center conductor having one end in contact with said metal case, and c) a dielectric material filling between said metal case and said center conductor, said metal case mounted on said casing and said center conductor connected to a power supply line in said casing, and said center conductor including a radiator formed by extending said center conductor and projecting from said metal case through a hole provided on an upper portion of said metal case.

2. A miniature antenna as set forth in claim 1, wherein a diameter of said radiator is approximately equal to a diameter of said semi-coaxial dielectric resonator.

3. A miniature antenna as set forth in claim 2, wherein said semi-coaxial dielectric resonator is held by a support member having a predetermined length, said support member provided on said casing and said support member serves as a power supply line.

4. A miniature antenna as set forth in claim 3, further comprising a surface current stopping member around said support member, said stopping member including a metal tube having a larger diameter than that of said support member with a bottom end of said metal tube electrically connected to said support member, and a dielectric filling between said metal tube and said support member.

5. A miniature antenna as set forth in claim 1, further comprising a metal skirt member having a larger diameter than that of said resonator with an upper end of the metal skirt member electrically connected to the upper portion of said semi-coaxial dielectric resonator, and said skirt member serves as a lower radiator and said radiator serves as an upper radiator of a miniature dipole antenna structure.

6. A miniature antenna as set forth in claim 5, wherein a diameter of said radiator is approximately equal to the diameter of said skirt member.

7. A miniature antenna as set forth in claim 6, wherein said semi-coaxial dielectric resonator is held by a support member having a predetermined length provided on said casing and said support member serves as a power supply line.

8. A miniature antenna as set forth in claim 7, further comprising a surface current stopping member around said support member and said stopping member including a metal tube having a larger diameter than that of said support member with a bottom end of the metal tube electrically connected to said support member, and a dielectric filling between said metal tube and said support member.

* * * * *